US011118758B1

(12) United States Patent
Greenspan et al.

(10) Patent No.: US 11,118,758 B1
(45) Date of Patent: Sep. 14, 2021

(54) LOUVERED OPTICS FOR LINEAR LIGHTING

(71) Applicant: Elemental LED, Inc., Reno, NV (US)

(72) Inventors: David Greenspan, Reno, NV (US); Robert Green, Reno, NV (US); Travis Irons, Reno, NV (US)

(73) Assignee: Elemental LED, Inc., Reno, NV (US)

( * ) Notice: Subject to any disclaimer, the term of this patent is extended or adjusted under 35 U.S.C. 154(b) by 0 days.

(21) Appl. No.: 17/088,501

(22) Filed: Nov. 3, 2020

(51) Int. Cl.

| | |
|---|---|
| ***F21V 11/08*** | (2006.01) |
| ***F21S 4/28*** | (2016.01) |
| ***F21V 5/04*** | (2006.01) |
| ***F21V 17/10*** | (2006.01) |
| *F21V 29/70* | (2015.01) |
| *F21Y 103/10* | (2016.01) |
| *F21Y 115/10* | (2016.01) |

(52) U.S. Cl.
CPC ..... *F21V 11/08* (2013.01); *F21S 4/28* (2016.01); *F21V 5/045* (2013.01); *F21V 17/10* (2013.01); *F21V 29/70* (2015.01); *F21Y 2103/10* (2016.08); *F21Y 2115/10* (2016.08)

(58) Field of Classification Search
CPC ..... F21V 11/08; F21V 5/045; F21V 17/10; F21V 29/70; F21S 4/28; F21Y 2115/10; F21Y 2103/10
See application file for complete search history.

(56) References Cited

U.S. PATENT DOCUMENTS

| | | | | |
|---|---|---|---|---|
| 8,556,451 | B1 * | 10/2013 | Wilkinson | F21V 21/005 362/217.05 |
| 10,190,738 | B1 * | 1/2019 | James | F21V 17/107 |
| 10,663,148 | B1 | 5/2020 | Heredia | |
| 10,788,170 | B1 | 9/2020 | Bryan | |
| 2003/0095410 | A1 * | 5/2003 | Caferro | F21V 11/00 362/291 |
| 2006/0109652 | A1 * | 5/2006 | Pfund | F21V 11/02 362/291 |
| 2009/0161371 | A1 * | 6/2009 | Vukosic | B60Q 1/2611 362/373 |

(Continued)

OTHER PUBLICATIONS

Graphical Analysis of Claim 1 using InnovationQPlus Discover; (Year: 2021).*

(Continued)

*Primary Examiner* — Rajarshi Chakraborty
*Assistant Examiner* — Glenn D Zimmerman
(74) *Attorney, Agent, or Firm* — United IP Counselors, LLC

(57) ABSTRACT

A linear luminaire is disclosed. The linear luminaire includes a channel, in which a strip of linear lighting is disclosed. The strip of linear lighting may have an individual optic positioned over each LED light engine. A set of louvers is provided. The set of louvers is arranged such that an individual louver is positioned over each one of the LED light engines. The individual louvers are generally cylindrical in shape. The individual louvers are connected by a web or platform that carries engaging structure allowing the set of louvers to snap or slide into the channel. The channel is covered with a channel cover, which has edges that extend out over at least a portion of the channel sidewalls, making it more difficult for dust and other foreign matter to enter the channel. The channel cover may be transparent.

13 Claims, 5 Drawing Sheets

(56) References Cited

U.S. PATENT DOCUMENTS

| | | | | |
|---|---|---|---|---|
| 2012/0134151 | A1* | 5/2012 | Jurik | F21V 13/02 362/235 |
| 2014/0016315 | A1* | 1/2014 | Yu | F21V 19/003 362/235 |
| 2015/0167901 | A1* | 6/2015 | Rodgers | F21V 3/00 362/222 |
| 2015/0316229 | A1* | 11/2015 | Jurik | F21V 5/046 362/237 |
| 2017/0227193 | A1* | 8/2017 | Yu | F21V 19/003 |
| 2018/0259142 | A1* | 9/2018 | Eddins | F21S 8/033 |

OTHER PUBLICATIONS

Elemental LED, Inc. "Optics by Diode LED® Flexible Strip Light: Specification Sheet," Oct. 23, 2020.

* cited by examiner

LOUVERED OPTICS FOR LINEAR LIGHTING

TECHNICAL FIELD

The invention relates to louvered linear lighting.

BACKGROUND

Linear lighting is a class of solid-state lighting in which an elongate, narrow printed circuit board (PCB) is populated with a number of light-emitting diode (LED) light engines, spaced from one another along the length of the PCB at a regular pitch or spacing. Depending on the application, the PCB may be either flexible or rigid.

Combined with an appropriate power supply, linear lighting is considered a luminaire in its own right, and it is also used as a raw material in the construction of more complex luminaires. One of the more common ways to make a luminaire is to place a strip of linear lighting in a channel and cover it with a cover. The channel is typically an extrusion of constant cross-section, made of a metal such as aluminum, although in some cases, channels for linear lighting may be made of plastic. The cover is usually at least translucent, and protects the linear lighting.

Unmodified, many LED light engines have a beam angle on the order of 120°. However, architects, lighting designers, and others prize control over the shape and width of an emitted beam of light, and such broad beams of light are not desirable in all situations. The usual solution to this problem is to use optical lenses to narrow or widen the beam of light. In simple embodiments, the cover may be given a convex or concave shape in order to serve as a lens, although more complex optical systems for linear lighting are known. For example, U.S. Pat. No. 10,788,170, the work of the present assignee and incorporated by reference in its entirely, discloses two-element optical systems for linear lighting that can narrow the beam of a typical strip of linear lighting installed in a channel. However, there are situations in which optics alone may not be enough to achieve a desired effect.

BRIEF SUMMARY

One aspect of the invention relates to a linear luminaire. The linear luminaire according to this aspect of the invention has a channel with sidewalls and a channel floor extending between the sidewalls. A strip of linear lighting is disposed on or near the channel floor. The strip of linear lighting may include an individual optic positioned over each LED light engine. A set of louvers is provided. The set of louvers is arranged such that an individual louver is positioned over each one of the LED light engines. The individual louvers are generally cylindrical in shape. The individual louvers are connected by a web or platform that extends transversely between the individual louvers, joining them, and that carries engaging structure allowing the set of louvers to snap or slide into the channel. The channel is covered with a channel cover, which has edges that extend out over at least a portion of the channel sidewalls, making it more difficult for dust and other foreign matter to enter the channel. The channel cover may be transparent.

In some embodiments, the channel may have a generally H-shaped cross-section, defining a first compartment in which the linear lighting and other components are disposed and a second compartment, opposite the first, in which mounting structure is disclosed. The mounting structure may be, e.g., a T-slot.

The louvers may extend from the individual optics nearly to the underside of the channel cover, such that they direct, contain, and constrain light emitted by the LED light engines. In some embodiments, the interior surface of the louvers may have a relatively rough surface finish, which may help to attenuate incident light.

The top edges of the channel sidewalls may be beveled, and the cover may extend over at least a portion of those beveled top edges with a complementary shape.

Other aspects, features, and advantages of the invention will be set forth in the description that follows.

BRIEF DESCRIPTION OF THE DRAWING FIGURES

The invention will be described with respect to the following drawing figures, in which like numerals represent like features throughout the description, and in which.

DETAILED DESCRIPTION

Figure 1:
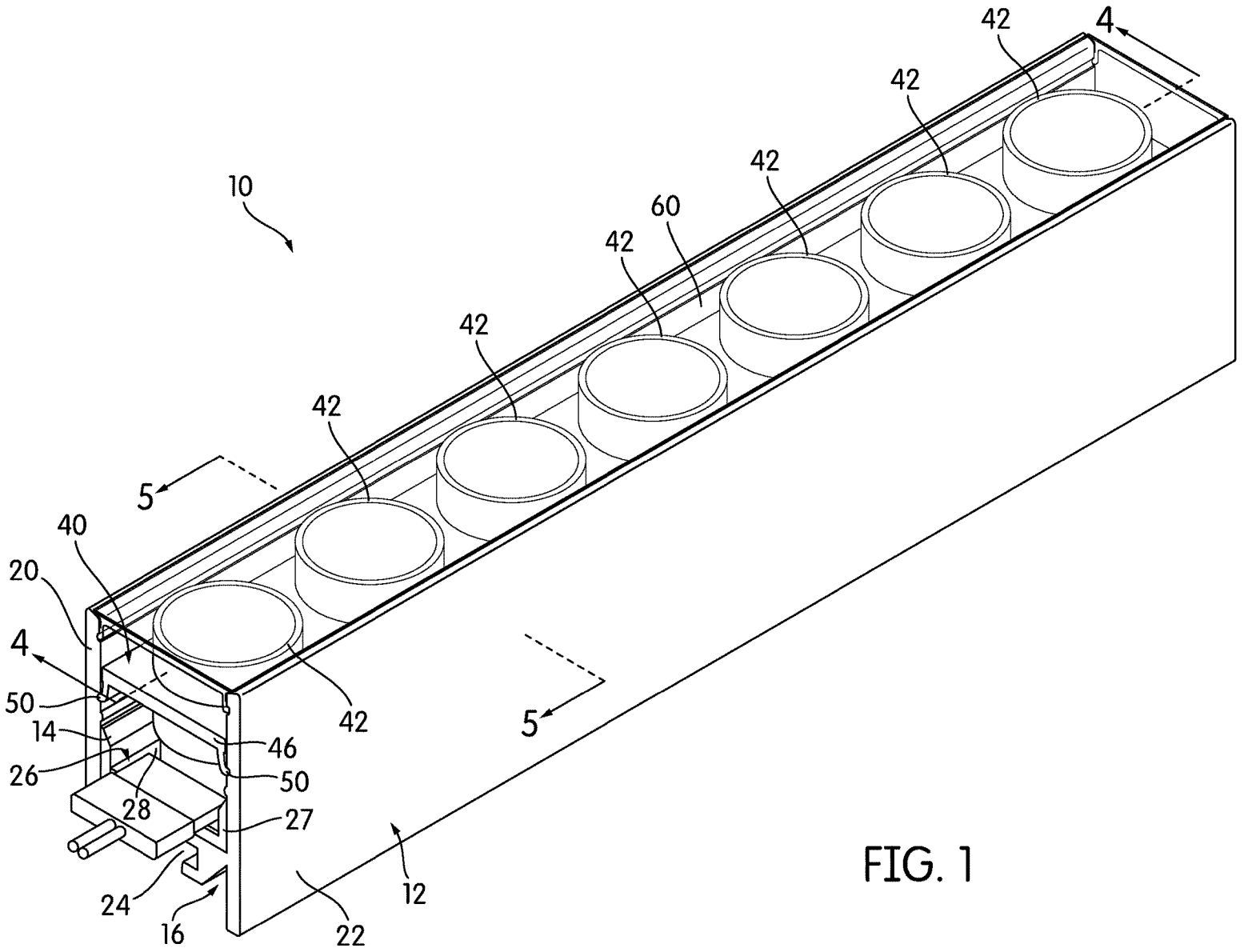
FIG. 1 is a perspective view of a linear luminaire according to one embodiment of the invention.
Figure 2:
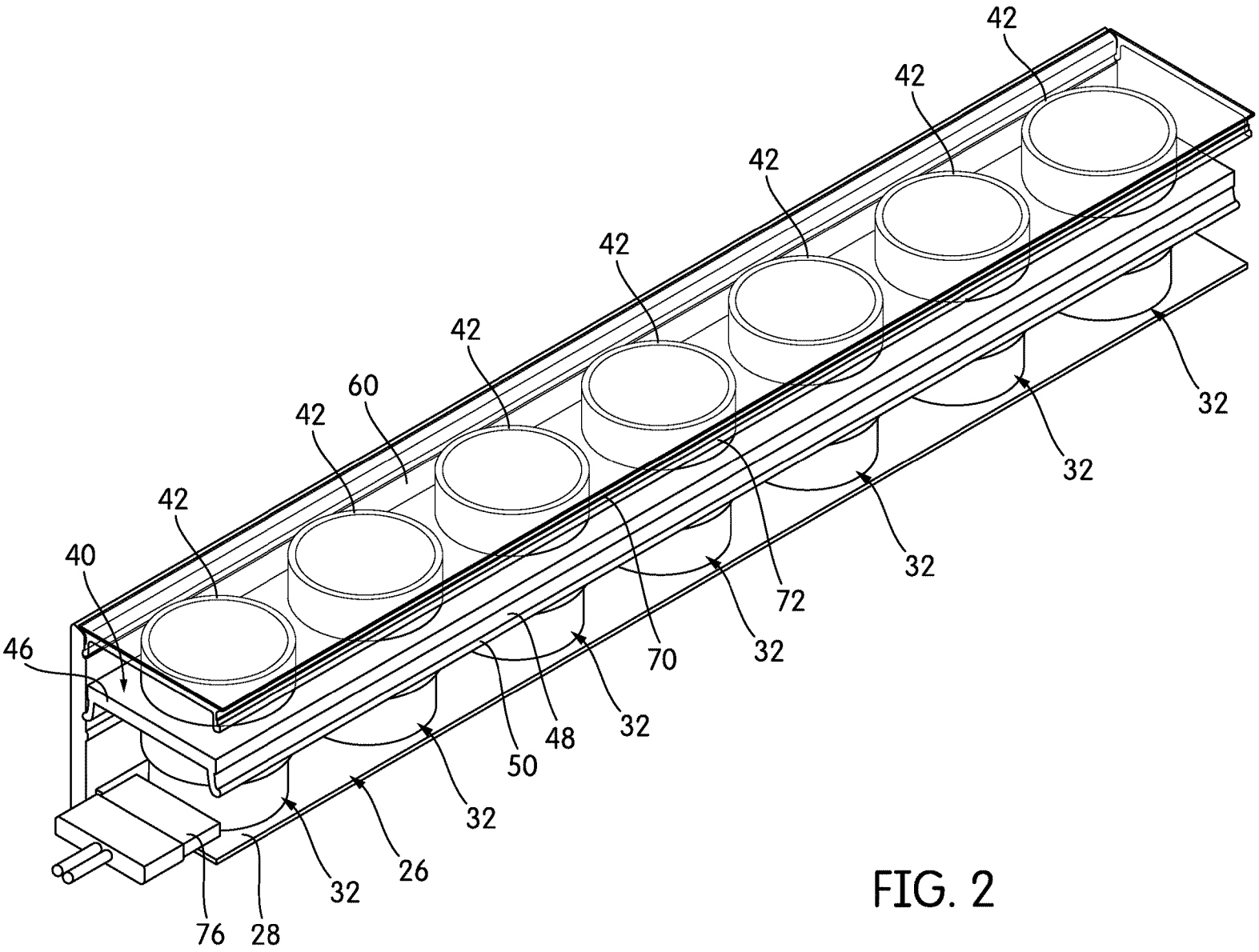
FIG. 2 is a perspective view of the linear luminaire of FIG. 1 with a portion of the channel removed.
Figure 3:
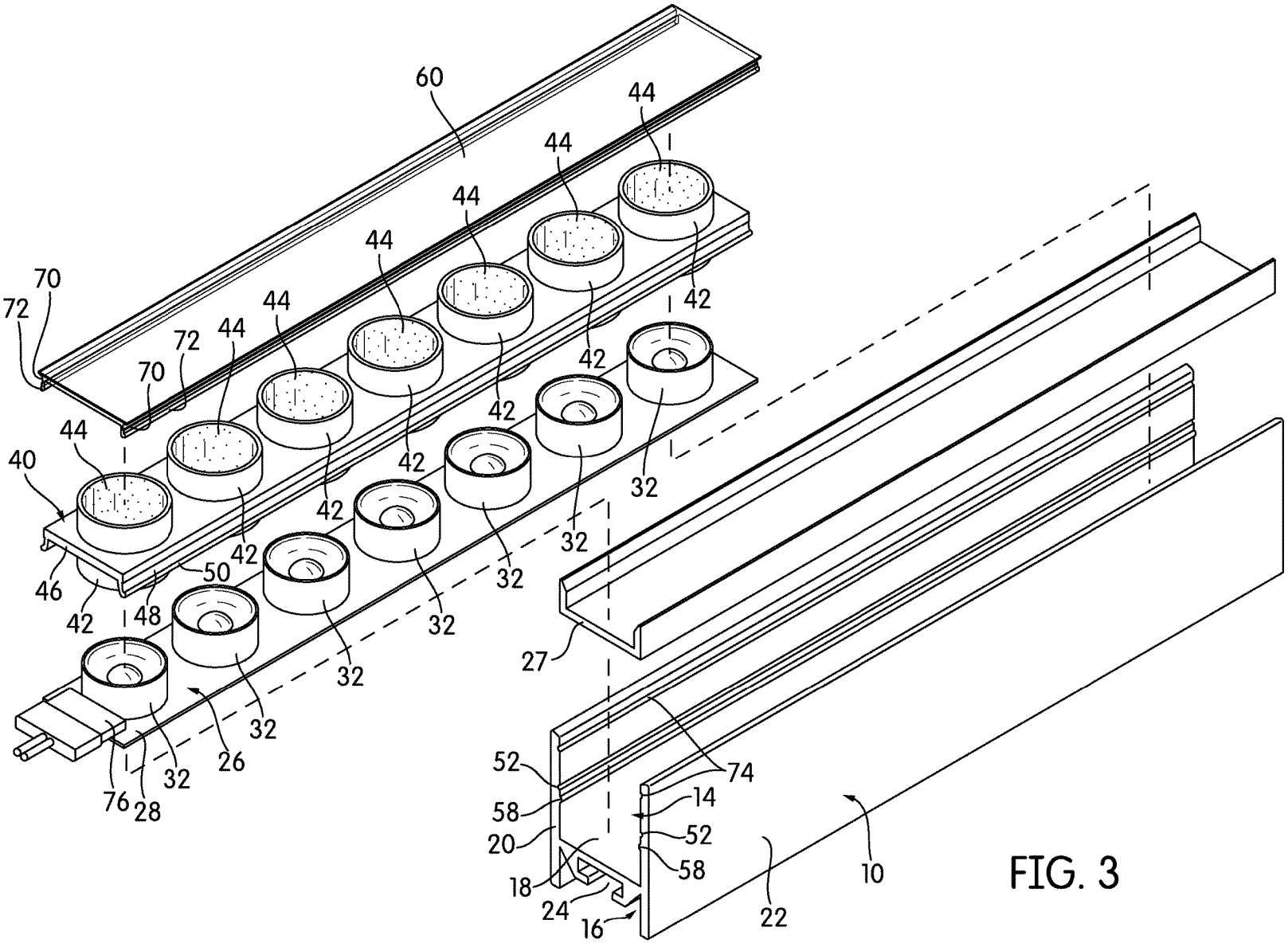
FIG. 3 is an exploded perspective view of the linear luminaire.

FIG. 1 is a perspective view of a linear luminaire, generally indicated at 10, according to one embodiment of the invention. The linear luminaire 10 includes and is housed in a channel 12. FIG. 2 is a similar perspective view with one side of the channel 12 removed, and FIG. 3 is an exploded perspective view. As shown, in FIGS. 1-3, the channel 12 has a first compartment 14 in which the other components of the luminaire 10 are placed, and a second compartment 16, opposite the first compartment 14, that is used in mounting the luminaire 10 to external structures.

The channel floor 18 of the channel 12 is set perpendicular to its sidewalls 20, 22, which are separated from each other by the channel floor 18, giving the channel 12 a generally H-shaped cross-section, with the first compartment 14 having a greater depth than the second compartment 16. The channel floor 18 itself is generally flat and level on the side that faces into the first compartment; on its opposite side, the channel floor 18 carries a T-slot 24 or another form of mounting structure, facing into the second compartment 16. The channel 12 has a constant cross-sectional shape, as will be described in greater detail below, and may be extruded. The channel 12 would typically be metal, e.g., anodized or painted extruded aluminum, although it may be made of plastic in some embodiments.

The channel 12 may have any shape, and need not necessarily have the H-shaped cross-section shown in the figures. A channel in another embodiment of the invention, for example, may be U-shaped or C-shaped, with only a single compartment. In some cases, channels may be modular, as described in U.S. Pat. No. 10,663,148, the contents of which are incorporated by reference herein in their entirety. In yet other embodiments, the second compartment 16 may be angularly displaced from the first compartment 14, instead of the two compartments 14, 16 being opposite one another across the channel floor 18. For example, the first compartment 14 may extend at a 15° angle, a 30° angle, a 45° angle, or any other desired angle.

A strip of linear lighting 26 lies within the channel 12, disposed in a shallow tray 27 that rests on the channel floor 18, although in some embodiments, the strip of linear lighting 26 may rest on the channel floor 18 itself. In this embodiment, the linear lighting 26 comprises a rigid printed circuit board (PCB) 28, on which seven individual LED light engines are installed, e.g., by surface mounting. The board itself may be, e.g., FR4, ceramic, or aluminum. In this description, the term "LED light engine" refers to an LED or LEDs, packaged with the wires and contacts necessary to make electrical contact with the PCB 28. The LED light engines in this embodiment may be of any type, including single-color LEDs or multi-color red-green-blue (RGB) LEDs that can emit light of any of a number of different colors. If the LEDs are intended to emit white light, they may be so-called "blue pump" LEDs that are topped with a phosphor, a chemical compound that absorbs the emitted blue light and re-emits light of a broader or different spectrum.

Figure 4:
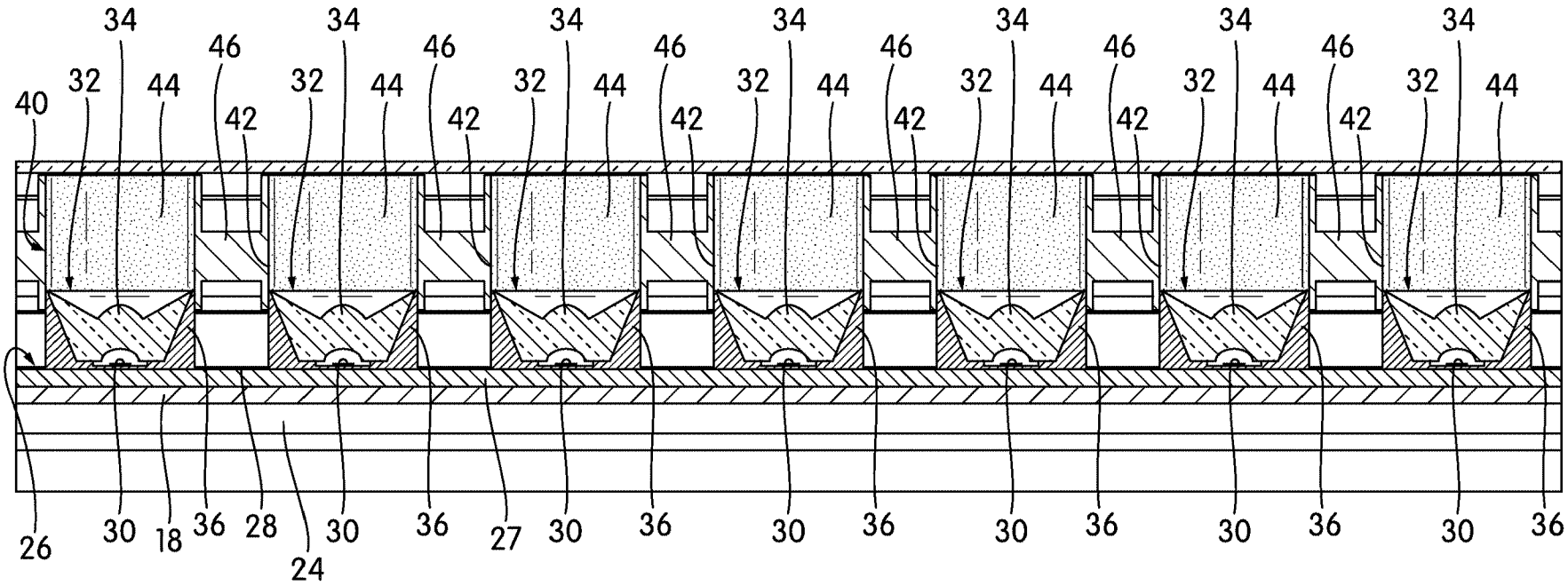
FIG. 4 is a cross-sectional view taken through Line 4-4 of FIG. 1.

The LED light engines themselves are not visible in the views of FIGS. 1-3. FIG. 4, a cross-sectional view taken through Line 4-4 of FIG. 1 illustrates the details of the LED light engines and their associated components. Each LED light engine 30 is covered with an individual optic 32. The optic 32 has two parts, a lens 34 centered over the LED light engine 30 and a reflector 36 surrounding the LED light engine 30. The optic 32 is roughly cylindrical in shape.

The optic 32 focuses and may also collimate the light emitted by the LED light engine 30. For example, in one embodiment, the optic 32 may be constructed and adapted to achieve a beam width of 15°, full width, half-maximum. The term "full width, half-maximum" refers to the fact that the full beam angle, measured edge-to-edge, is 15°, and that at the edges of that beam, the beam intensity is half of the maximum intensity.

In order to provide additional control over the shape and width of the light beams, a set of louvers 40 is installed over the individual optics 32. The set of louvers 40 includes an individual louver 42 for each of the optics 32. Each louver 42 is a hollow cylinder in overall shape, with an inner diameter that is just larger than the outer diameter of each optic 32, such that the louvers 42 fit over the optics 32 with minimal circumferential gaps between them. The louvers 42 physically constrain the beam of light emitted by each optic 32. In the illustrated embodiment, the louvers 42 may have a dark color, and the inner circumference 44 of each louver 40 has a relatively rough finish, so as to scatter any light rays that are incident on its surface. While this is not required in all embodiments, it may help to attenuate off-axis light rays. As those of skill in the art will note, only the inner shape of the louvers 42 matters in terms of their light-directing ability; the outer surfaces of the louvers 42 need not be cylindrical in all embodiments.

Figure 5:
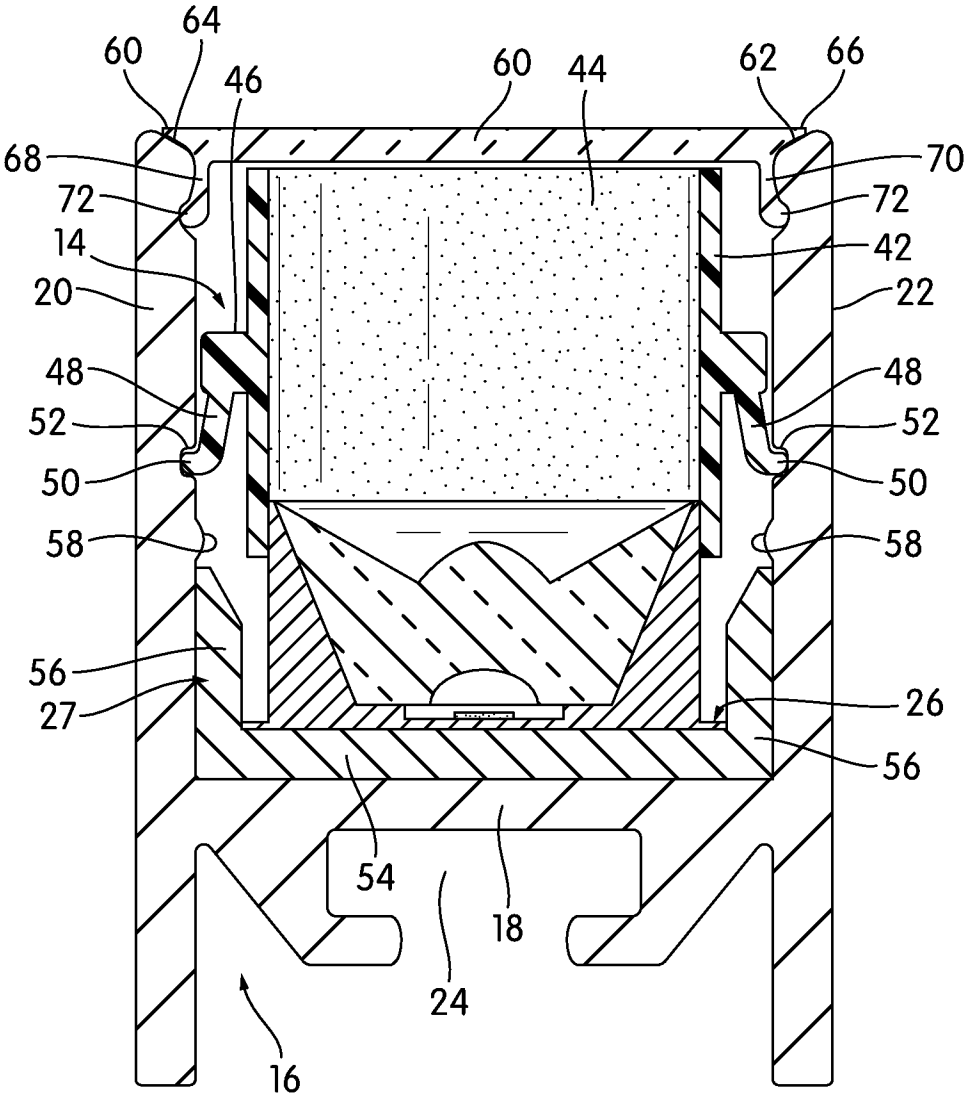
FIG. 5 is a cross-sectional view taken through Line 5-5 of FIG. 1.

FIG. 5 is an end cross-sectional view of the luminaire 10, taken through Line 5-5 of FIG. 1. As can be seen in FIG. 5, and also in the exploded perspective view of FIG. 3, the set of louvers 40 is formed in a single piece. More specifically, a horizontally-extending web or platform 46 extends between the individual louvers 42 to bind them into a single unit. The platform 46 of the illustrated embodiment attaches to the individual louvers 42 at their vertical midpoints, in the manner of a horizontal bisecting plane. The plane in which the platform 46 attaches to the individual louvers 42 is not critical. In the illustrated embodiment, the platform 46 is opaque, such that light can only pass through the individual louvers 42. Because the features of the set of louvers 40 result in a cross-section that differs along its length, the set of louvers 40 would typically be molded in sections, machined, or cast, rather than extruded.

The platform 46 also provides the mechanism by which the set of louvers 40 is adapted to be mounted in the channel 12. More specifically, the platform has a depending, outwardly-extending flange 48 on each side that terminates in a projection 50. Each projection 50 fits into a groove 52 inset into the inner face of each sidewall 20, 22. This secures the set of louvers 40 in the channel 12.

Other features are also visible in the view of FIG. 5. As was noted briefly above, the strip of linear lighting 26 lies within a shallow tray 27. The tray 27 has a bottom 54 and a pair of upright sidewalls 56 that arise from the bottom and extend generally perpendicular to it. The sidewalls 56 are beveled at their upper edges. As shown, each sidewall 20, 22 of the channel 12 has a ridge 58. The sidewalls 56 extend up to the ridges 58, such that the ridges 58 restrain and help to secure the tray 27. The tray 27 itself may provide additional mechanical support for the linear lighting 26, additional heat sinking, and may make it easier to remove and replace the linear lighting 26, among other functions and advantages. While the linear lighting 26 and the tray 27 are shown separately in the drawing figures, they may be permanently bonded together at the time of manufacturing and then slid into place when the luminaire 10 is assembled.

At their upper extents, the individual louvers 42 come very close to the underside of the channel cover 60. The cover 60 is essentially flat along its upper and lower sides, such that it does not have a lensing effect on the light the passes through it. It may be either clear or translucent, although because the optics 32 and louvers 42 already exert control over the emitted light, it may be advantageous if the cover 60 is clear and does not diffuse the light that passes through it, other than by ordinary refraction as the light is incident on and passes through the cover 60, which would typically be made of a plastic.

With no lensing properties and no diffusing properties or additives, one major function of the cover 60 in the illustrated embodiment is to protect the channel 12 from the ingress of dust and other foreign material. The sidewalls 20, 22 have beveled upper edges 62. The upper side edges 64, 66 of the cover 60 extend over the beveled upper edges 62 of the sidewalls 20, 22. This leaves no cracks, seams, or openings over the first compartment 14 of the channel 12, thus making it harder for foreign matter to enter the first compartment 14 at a seam between the cover 60 and the channel 12. Similar to the set of louvers 40, the cover has depending legs 70 with protuberances 72 that engage grooves 74 set into the inner faces of the sidewalls 20, 22.

Thus, the linear luminaire 10 provides a line of light with controlled beam widths. The set of louvers 40 that helps to control the beam widths has individual round louvers 42 for each LED light engine 30 and its associated optic 32. The set of louvers 40 and a separate channel cover 60 are adapted to snap easily into the channel 12. The ends of the channel 12 would typically be covered with endcaps, which may "snap in" to the ends of the channel 12 using features disposed in either the first compartment 14 or the second compartment 16. Although the set of louvers 40 of this embodiment uses individual round louvers 42, the arrangement of the parts in the linear luminaire 10 is interchangeable. The set of louvers 40 can easily be swapped out for another set, and while round louvers are shown in the illustrated embodiment, louvers of other shapes and characteristics could be used.

As shown, the PCB 28 includes a power connector 76 that provides for a relatively easy push-in connection with a power source. If endcaps are provided, the power connector 76 may be incorporated into an endcap, or the endcap may provide an opening for it.

The above description refers to the function of the set of louvers 40 as "controlling the beam width," yet that is something of a simplification, offered for ease in explanation. As was explained above, the beam widths set forth here are defined as "full width, half-maximum." This means that at the edges of the beam, there is still a significant amount of light energy, although that light energy may not be usable in the particular application. This unusable light at the edge of a beam of light is sometimes referred to as "spill light." Spill light can be a nuisance in general, and when it is reflected into or enters the eyes, it becomes glare. The set of louvers 40 may help to reduce spill light, and thus, glare. In other words, when a set of louvers 40 is used, the usable beam width may or may not change—the beam may still be, e.g., a 15° full width, half-maximum beam of light. However, a louver 42 may modify or control the beam such that its spill light, and thus its potential for glare, is vastly reduced. For these reasons, the term "controlling the beam width" should be read to include controlling one or both of usable light and unusable spill light.

While the invention has been described with respect to certain embodiments, the description is intended to be exemplary, rather than limiting. Modifications and changes may be made within the scope of the invention, which is defined by the appended claims.

What is claimed is:

1. A linear luminaire, comprising:

a channel including a channel floor and a pair of sidewalls that arises from opposite edges of the channel floor;

a strip of linear lighting disposed on or close to the channel floor, the strip of linear lighting including a plurality of light engines arranged to emit light in an emission direction;

a set of louvers including an individual louver for each of the plurality of light engines, arranged such that one of the individual louvers is aligned over and is configured to physically constrain light emitted from each of the plurality of light engines, and a web connecting the individual louvers, the web carrying engaging structure to engage the pair of sidewalls of the channel; and a channel cover adapted to engage the pair of sidewalls to cover and close the channel.

2. The linear luminaire of claim 1, wherein sides of the channel cover have edges that extend over at least a portion of the pair of sidewalls.

3. The linear luminaire of claim 1, wherein the channel cover is clear.

4. The linear luminaire of claim 1, wherein inner walls of the individual louvers are roughened.

5. The linear luminaire of claim 1, the strip of linear lighting further comprising a plurality of individual optics, one of the plurality of individual optics corresponding to each of the plurality of light engines, such that one of the individual louvers is aligned over each of the plurality of individual optics.

6. The linear luminaire of claim 1, wherein the engaging structure of the web comprises flanges that are adapted to engage grooves provided in the sidewalls.

7. The linear luminaire of claim 1, further comprising a tray in which the strip of linear lighting is disposed, the tray being disposed on the channel floor.

8. The linear luminaire of claim 1, wherein the set of louvers reduces spill light from the plurality of light engines.

9. The linear luminaire of claim 1, wherein the individual louvers are generally cylindrical in overall shape.

10. The linear luminaire of claim 1, wherein the set of louvers engages the channel releasably.

11. The linear luminaire of claim 1, wherein the web is opaque.

12. The linear luminaire of claim 2, wherein upper edges of the pair of sidewalls are beveled.

13. The linear luminaire of claim 5, wherein the individual louvers extend from the plurality of individual optics to a position just under the cover.

* * * * *